US007665404B2

(12) United States Patent
Yeh

(10) Patent No.: US 7,665,404 B2
(45) Date of Patent: Feb. 23, 2010

(54) FOLDABLE FLORAL TABLE

(76) Inventor: Jui-Ju Yeh, 14F, No. 223, Sec. 5, Nanking E. Rd., Taipei (TW)

( * ) Notice: Subject to any disclaimer, the term of this patent is extended or adjusted under 35 U.S.C. 154(b) by 399 days.

(21) Appl. No.: 11/889,377

(22) Filed: Aug. 13, 2007

(65) Prior Publication Data

US 2009/0044733 A1 Feb. 19, 2009

(51) Int. Cl.
*A47B 3/08* (2006.01)

(52) U.S. Cl. ..... 108/115; 108/145; 211/149

(58) Field of Classification Search ..... 108/166, 108/144.11, 145, 115, 132, 6, 7; 47/45; 248/168, 248/169; 211/149, 195, 201, 200
See application file for complete search history.

(56) References Cited

U.S. PATENT DOCUMENTS

| | | | | | |
|---|---|---|---|---|---|
| 318,298 | A | * | 5/1885 | Roberts | 108/124 |
| 439,186 | A | * | 10/1890 | Reams | 108/9 |
| 753,993 | A | * | 3/1904 | Mauran | 211/198 |
| 997,079 | A | * | 7/1911 | Moraff | 108/176 |
| 1,259,580 | A | * | 3/1918 | Wurz | 108/124 |
| D80,586 | S | * | 2/1930 | Thomas | D6/429 |
| 2,086,380 | A | * | 7/1937 | Flagstad | 108/124 |
| 2,591,797 | A | * | 4/1952 | Exline et al. | 108/62 |
| 3,442,351 | A | * | 5/1969 | Parrish et al. | 182/141 |
| 4,905,612 | A | * | 3/1990 | Apissomian | 108/157.15 |

FOREIGN PATENT DOCUMENTS

EP 1460164 * 11/2003

* cited by examiner

*Primary Examiner*—Janet M Wilkens
(74) *Attorney, Agent, or Firm*—Bacon & Thomas, PLLC

(57) ABSTRACT

A foldable floral table has a foldable stand and a tabletop. The foldable stand has two leg assemblies and two articulated brackets. The leg assemblies connect pivotally to each other and each leg assembly has two legs and at least one crossbar. Each leg has a top support. The articulated brackets pivotally connect adjacent legs in different leg assemblies and selectively hold the leg assemblies in an expanded configuration or allow the leg assemblies to be folded. Each articulated bracket has two ends and a central joint. The tabletop is pivotally connected to the central joint of the articulated bracket and is held in place by the top supports of the legs when the leg assemblies are unfolded. With the pivotal connections between the leg assemblies, the articulated brackets and the tabletop, the floral table is folded to a minimum volume for convenient storage and transportation.

9 Claims, 5 Drawing Sheets

FOLDABLE FLORAL TABLE

BACKGROUND OF THE INVENTION

1. Field of the Invention

The present invention relates to a floral table, especially to a foldable floral table.

2. Description of the Prior Arts

For decoration, potted plants, flower arrangements and the like are placed in houses, in offices or outdoors. Potted plants and flower arrangements are often placed on conventional floral tables to display the plants and flower arrangements and expose live plants conveniently to sunlight. A conventional floral table comprises a tabletop and a stand. The stand connects securely to the tabletop to support the tabletop and stands on the ground. Potted plants, flower arrangements and the like are displayed on the tabletop. However, a conventional floral table occupies a fixed volume and is not easy to stow and transport.

To overcome the shortcomings, the present invention provides a foldable floral table to mitigate or obviate the aforementioned problems.

SUMMARY OF THE INVENTION

The main objective of the present invention is to provide a foldable floral table. The foldable floral table in accordance with the present invention comprises a foldable stand and a tabletop. The foldable stand comprises two leg assemblies and two articulated brackets. The leg assemblies connect pivotally to each other, and each leg assembly comprises two legs and at least one crossbar. Each leg has a top support. The articulated brackets pivotally connect adjacent legs in different leg assemblies and selectively hold the leg assemblies in an expanded configuration or allow the leg assemblies to be folded. Each articulated bracket has two ends and a central joint. The tabletop is pivotally connected to the central joint of the articulated bracket and is held in place by the top supports of the legs when the leg assemblies are unfolded. With the pivotal connections between the leg assemblies, the articulated brackets and the tabletop, the floral table is folded to a minimum volume for convenient storage and transportation.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
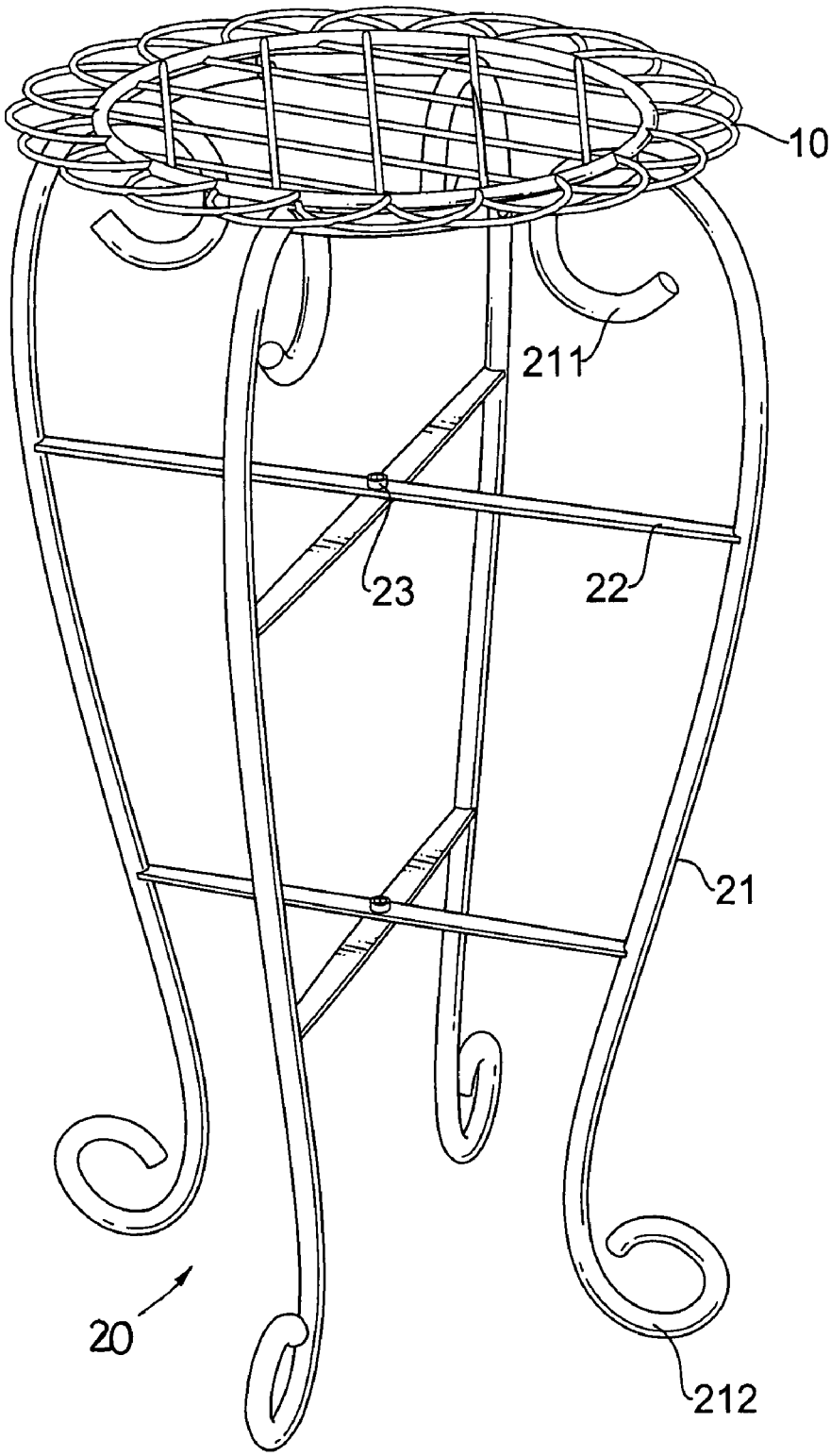
FIG. 1 is a perspective view of a foldable floral table in accordance with the present invention.
Figure 2:
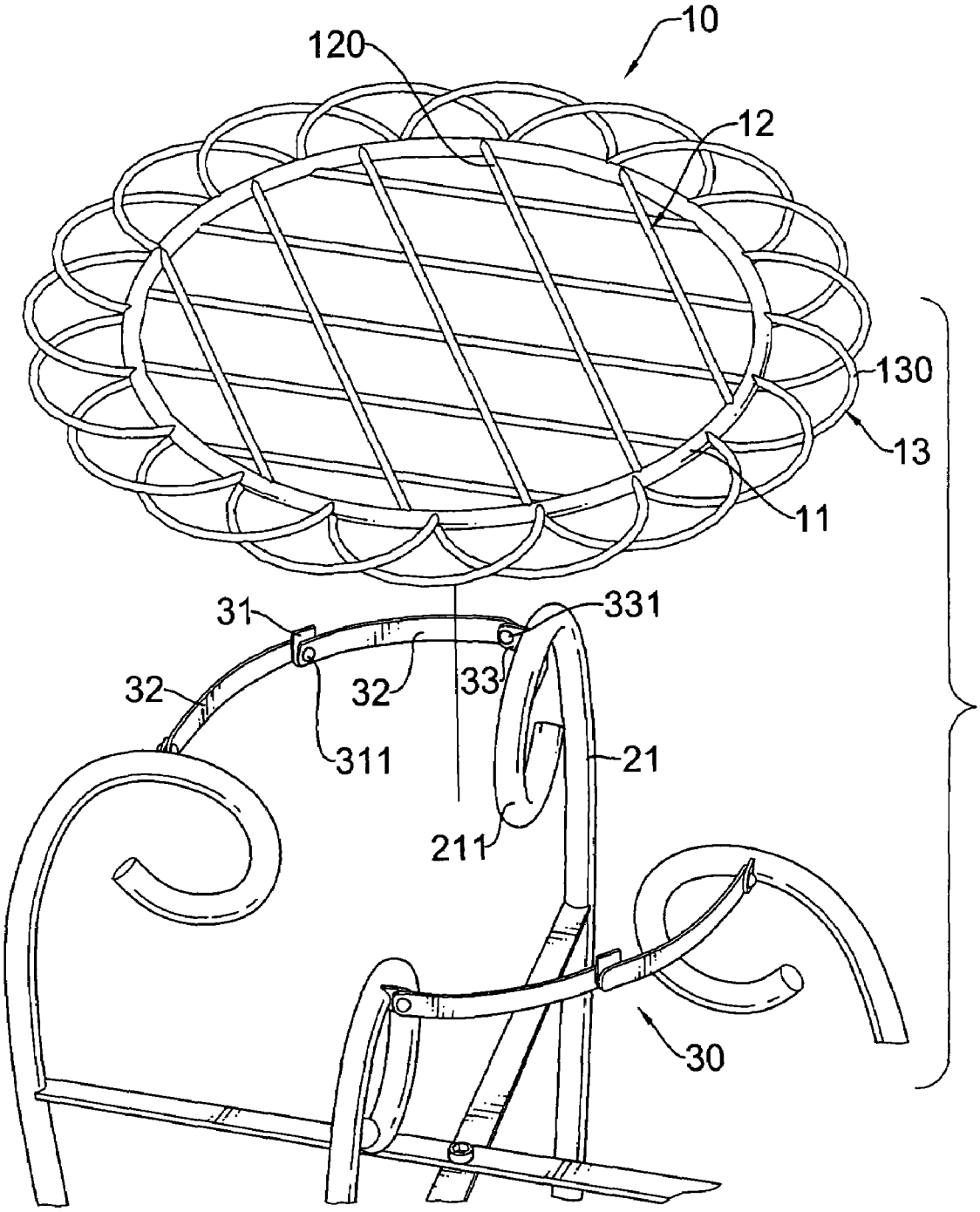
FIG. 2 is an enlarged exploded perspective view of the foldable floral table in FIG. 1.

With reference to FIGS. 1 and 2, a foldable floral table in accordance with the present invention comprises a foldable stand and a tabletop (10).

The foldable stand stands on a horizontal surface and comprises two leg assemblies (20) and two articulated brackets (30).

The leg assemblies (20) connect pivotally to each other, and each leg assembly (20) comprises two legs (21) and at least one crossbar (22). Each leg (21) has a top support (211) and a foot (212). The top support (211) may be curved. The foot (212) stands on the ground and may be curved. The at least on crossbar (22) is mounted securely between the legs (21) and connects pivotally to a corresponding crossbar (22) in the other leg assembly (20) to connect the leg assemblies (20) pivotally to each other. The corresponding crossbars (22) may connect pivotally to each other by a rivet (23).

Figure 3:
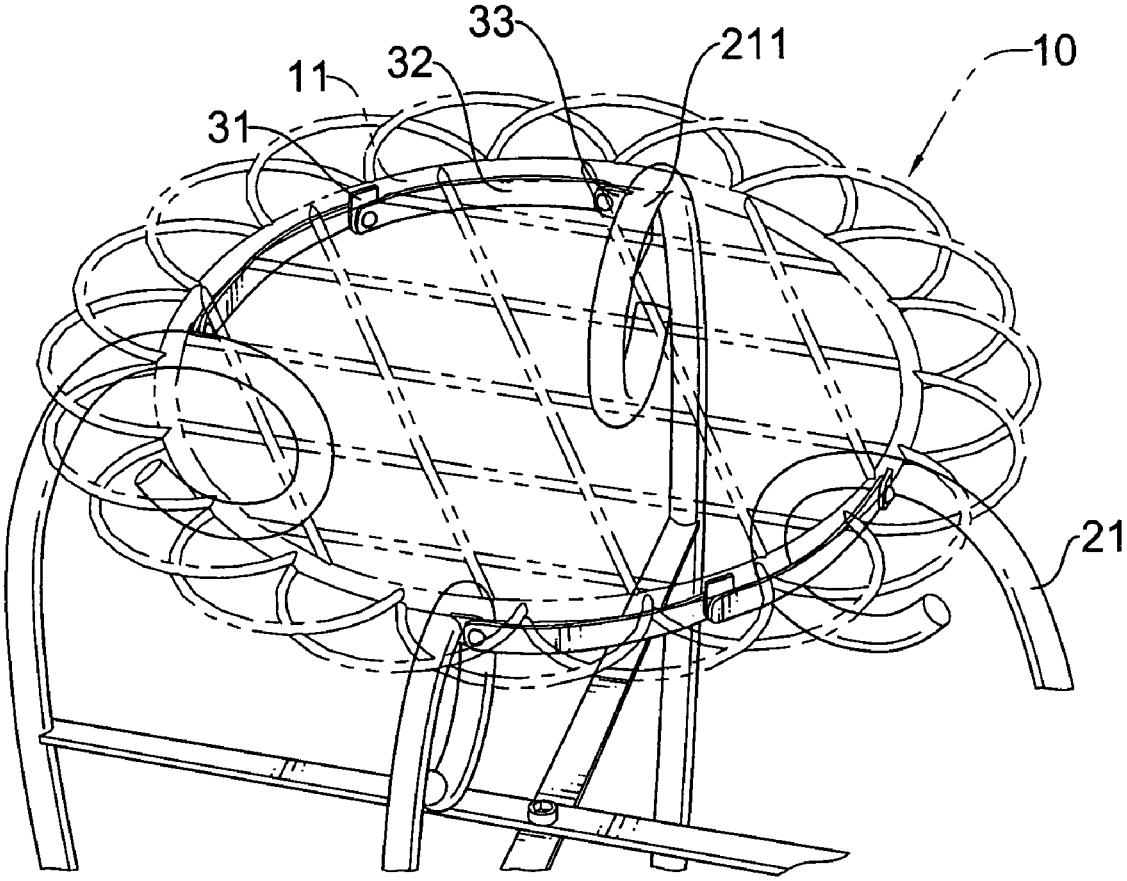
FIG. 3 is a perspective view of the foldable floral table in FIG. 2.

With further reference to FIG. 3, the articulated brackets (30) are foldable, pivotally connect adjacent legs (21) in different leg assemblies (20) and selectively hold the leg assemblies (20) in an expanded configuration or allow the leg assemblies (20) to be folded. Each articulated bracket (30) comprises a central joint (31), two folding arms (32) and two pivot brackets (33). The central joint (31) may have a rivet (311). The folding arms (32) connect pivotally to the central joint (31). Each folding arm (32) has an inner end and an outer end. The inner ends of the folding arms (32) are connected pivotally to the central joint (31) and may be connected pivotally by a rivet (311). The pivot brackets (33) connect pivotally to the folding arms (32) and are securely attached respectively to adjacent legs (21) in different leg assemblies (20). Each pivot bracket (33) connects pivotally to the outer end of the corresponding folding arm (32) and is attached securely to the top support (211) of the corresponding leg (21). The pivot brackets (33) and the folding arms (32) may connect pivotally to each other by rivets (331).

Figure 4:
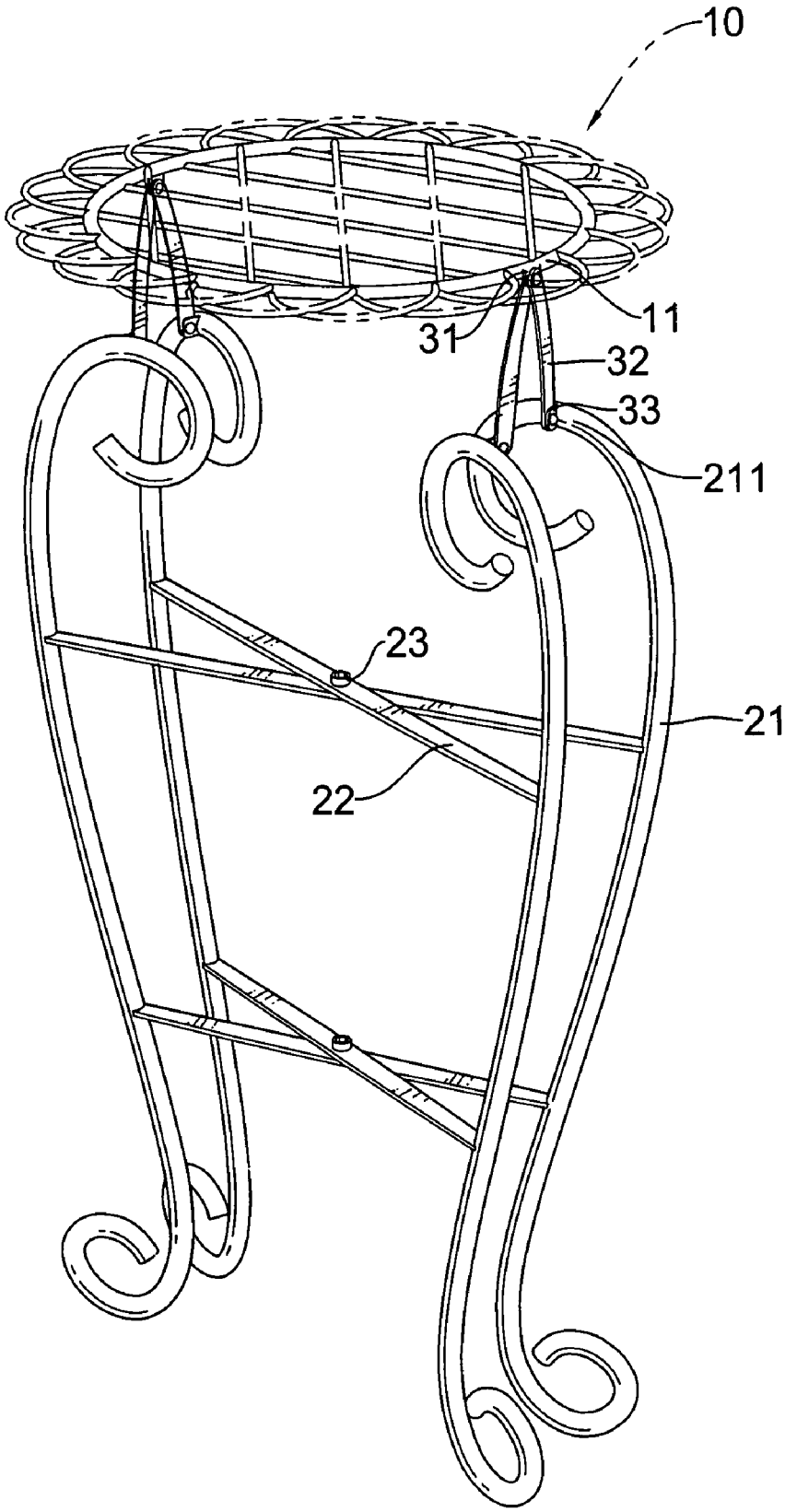
FIG. 4 is an operational perspective view of the foldable floral table in FIG. 1 being folded.
Figure 5:
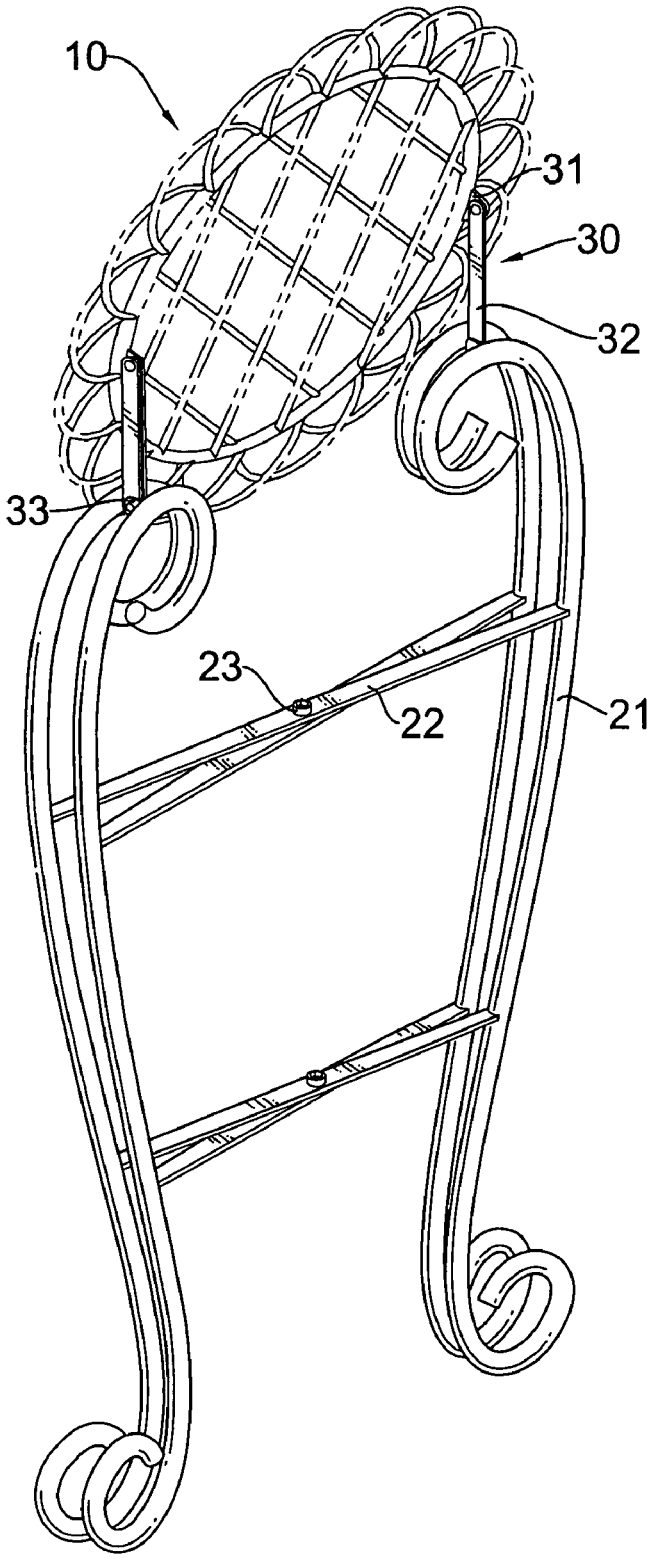
FIG. 5 is another operational perspective view of the floral table in FIG. 1 folded.

With further reference to FIGS. 4 and 5, the tabletop (10) is connected to the central joints (31) of the articulated brackets (30), is held on the top supports (211) of the legs (21) when the foldable stand is expanded, pivots parallel to the folded folding arms (32) and leg assemblies (20) and comprises a ring (11), a central panel (12) and an optional outer frame (13).

The ring (11) is connected to the central joints (31) of the articulated brackets (30) and has an inner annular edge and an outer annular edge.

The central panel (12) connects to the inner annular edge of the ring (11), may be net-shaped and may have multiple straight rods (120). The straight rods (120) connect to the inner annular edge of the ring (11) and crisscross each other to form the net-shaped central panel (12).

The outer frame (13) connects to the outer annular edge of the ring (11), may be net-shaped and may have multiple curved rods (130). The curved rods (130) connect to the outer annular edge of the ring (11) and crisscross adjacent curved rods to form the net-shaped outer frame (13).

Because the tabletop (10), the legs (21) and the crossbars (22) are essentially parallel to each other, the folded floral table occupies a minimum volume for convenient storage and transportation.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A foldable floral table comprising:

a foldable stand having two leg assemblies connecting pivotally to each other, and each leg assembly comprising two legs, and each leg having a top support; and a foot; and at least one crossbar mounted securely between the legs, wherein each one of the at least one crossbar of one leg assembly is adjacent to and mounted pivotally on one of the at least one crossbar of the other leg assembly; and two articulated brackets being foldable and pivotally connecting adjacent legs in different leg assemblies, and each articulated bracket comprising a central joint;

two folding arms connecting pivotally to the central joint, and each folding arm having an inner end connected pivotally to the central joint; and an outer end; and two pivot brackets connecting pivotally to the folding arms and securely attached respectively to adjacent legs in different leg assemblies, and each pivot bracket connecting pivotally to the outer end of a corresponding folding arm and attached securely to the top support of a corresponding leg; and a tabletop being connected to the central joints of the articulated brackets, being held on the top support of the legs when the foldable stand is expanded, pivoting parallel to the folded folding arms and leg assemblies and comprising a ring being connected to the central joints of the articulated brackets and having an inner annular edge; and an outer annular edge; and a central panel connecting to the inner annular edge of the ring.

2. The foldable floral table as claimed in claim 1, wherein the tabletop further has an outer frame connecting to the outer annular edge of the ring.

3. The foldable floral table as claimed in claim 2, wherein the central panel of the tabletop is net-shaped and has multiple straight rods connecting to the inner annular edge of the ring and crisscrossing each other; and the outer frame of the tabletop is net-shaped and has multiple curved rods connecting to the outer annular edge of the ring and crisscrossing adjacent curved rods.

4. The foldable floral table as claimed in claim 3, wherein the top supports and feet of the legs are curved.

5. The foldable floral table as claimed in claim 4, wherein the pivotally connected crossbars of the leg assemblies connect pivotally to each other by a rivet;

the inner end of each folding arm and the corresponding central joint are mounted pivotally to each other by a rivet; and the pivot brackets and the folding arms connect pivotally to each other by rivets.

6. The foldable floral table as claimed in claim 5, wherein each leg assembly has multiple crossbars.

7. The foldable floral table as claimed in claim 1, wherein the top supports and feet of the legs are curved.

8. The foldable floral table as claimed in claim 1, wherein the pivotally connected crossbars of the leg assemblies connect pivotally to each other by a rivet;

the inner end of each folding arm and the corresponding central joint are mounted pivotally to each other by a rivet; and the pivot brackets and the folding arms connect pivotally to each other by rivets.

9. The foldable floral table as claimed in claim 1, wherein each leg assembly has multiple crossbars.

* * * * *